US005143629A

United States Patent [19]

Lint

[11] Patent Number: 5,143,629

[45] Date of Patent: Sep. 1, 1992

[54] APPARATUS AND METHOD FOR MINIMIZING AND RECOVERING FLUID CARGO SPILLS

[76] Inventor: Christian L. Lint, P.O. Box 9884, Seattle, Wash. 98109

[21] Appl. No.: 535,469

[22] Filed: Jun. 8, 1990

[51] Int. Cl.[5] ..... E02B 15/04

[52] U.S. Cl. ..... 210/776; 210/242.3; 210/299; 210/416.1; 210/923

[58] Field of Search ..... 210/242.3, 242.4, 776, 210/923, 924, 258, 299, 416.1, 416.5, 446, 776; 15/1.7, 327.6, 302, 353, 475, 421

[56] References Cited

U.S. PATENT DOCUMENTS

| | | | |
|---|---|---|---|
| 961,816 | 6/1910 | Squier | 13/421 |
| 1,053,665 | 2/1913 | Spencer | 15/421 |
| 2,330,508 | 9/1943 | McCall | 210/923 |
| 3,532,219 | 10/1970 | Valdespino | 210/242.3 |
| 3,536,199 | 10/1970 | Cornelius | 210/923 |
| 3,578,171 | 5/1971 | Usher | 210/923 |
| 3,669,275 | 6/1972 | Downs | 210/924 |
| 3,727,766 | 4/1973 | Horne et al. | 210/923 |
| 3,760,944 | 9/1973 | Bell et al. | 210/923 |
| 3,813,887 | 6/1974 | Kruger et al. | 114/51 |
| 3,850,807 | 11/1974 | Jones | 210/923 |
| 3,859,944 | 1/1975 | Warner | 114/74 R |
| 4,008,156 | 2/1977 | Chaston-Bagnis | 210/923 |
| 4,060,487 | 11/1977 | Samsel | 210/242.3 |
| 4,241,683 | 12/1980 | Conway | 114/74 R |
| 4,246,676 | 1/1981 | Hallsworth et al. | 15/353 |
| 4,575,426 | 3/1986 | Littlejohn et al. | 210/924 |

*Primary Examiner*—Peter Hruskoci
*Assistant Examiner*—Christopher Upton
*Attorney, Agent, or Firm*—Seed and Berry

[57] ABSTRACT

An apparatus for preventing or minimizing spilled fluid cargo in a marine environment, and for recovering that fluid cargo which does spill is disclosed. The apparatus consists of vacuum source can be connected with each hold of a marine cargo vessel and used to evacuate the holds after they are filled with fluid cargo, thereby preventing or minimizing fluid cargo loss due to a breach of the holds. Also disclosed is the use of a vacuum source which is connected to a substantially airtight enclosure, typically a tank or a hold of a marine cargo vessel, and a pickup mechanism with a pickup passage that has one end connected to the tank or cargo hold and a second end connected to at least one pickup nozzle to recover spilled fluid cargo. The apparatus may be a permanently installed on a marine cargo vessel, or it may use a port seal which fits over a port in the tank or hold with at least two apertures to provide connections with the vacuum source and the pickup means only when the apparatus is needed to recover materials. Methods for minimizing fluid cargo loss and for recovering spilled fluid cargo also are disclosed.

9 Claims, 8 Drawing Sheets

FIG. 1
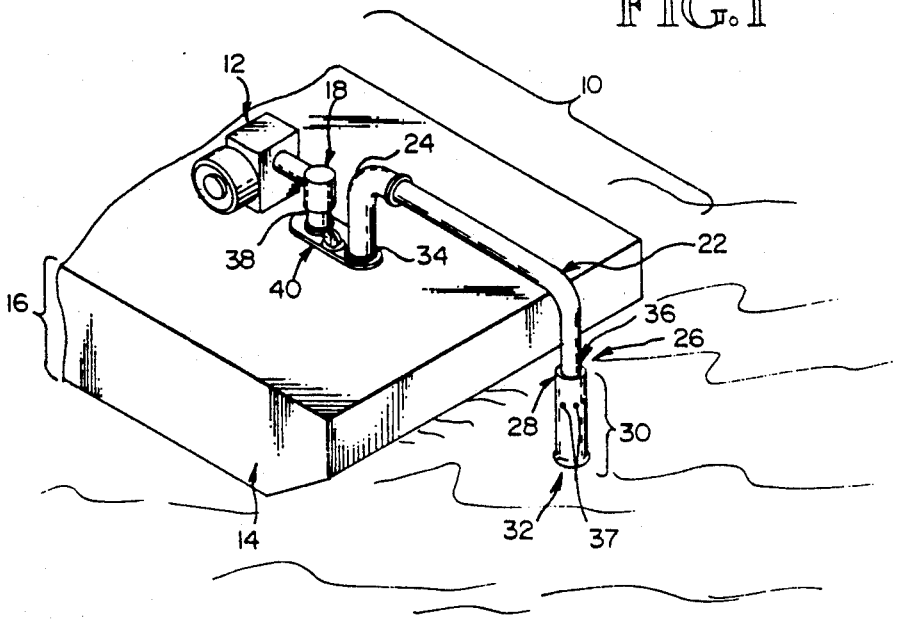
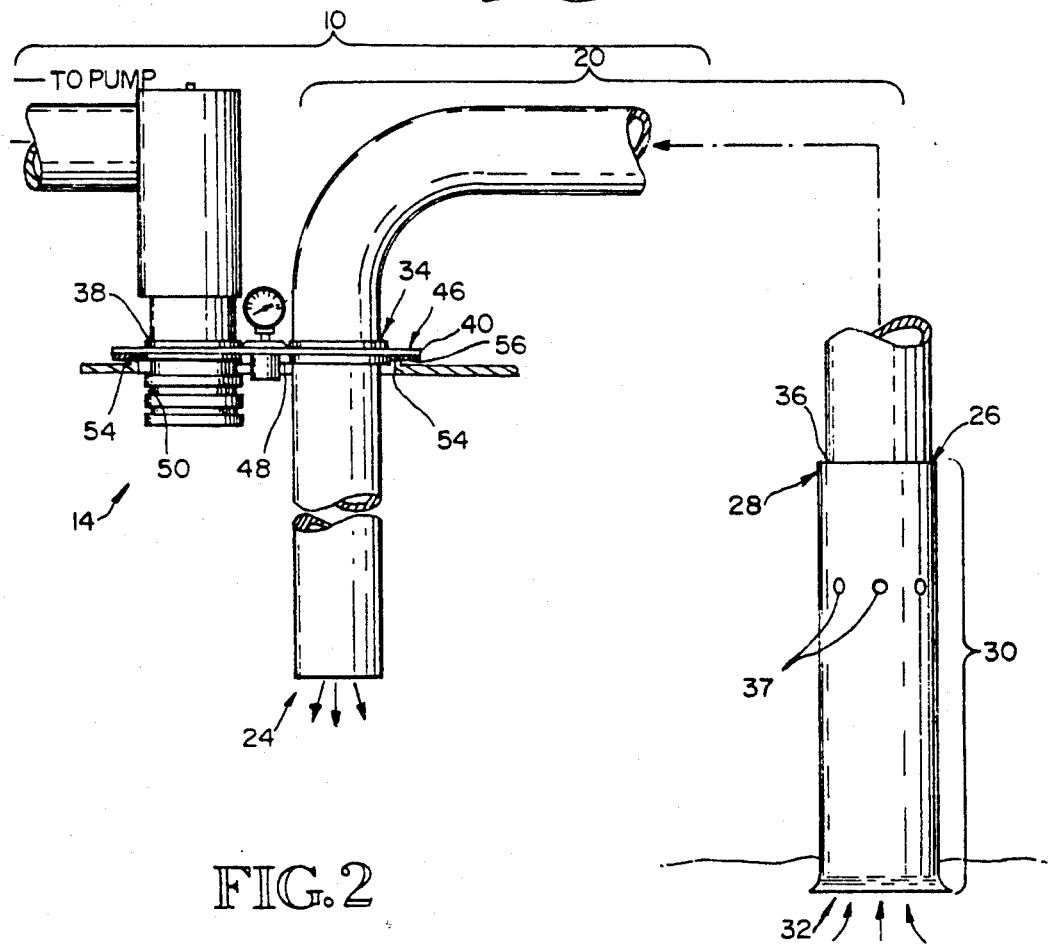
FIG. 2

FIG. 3
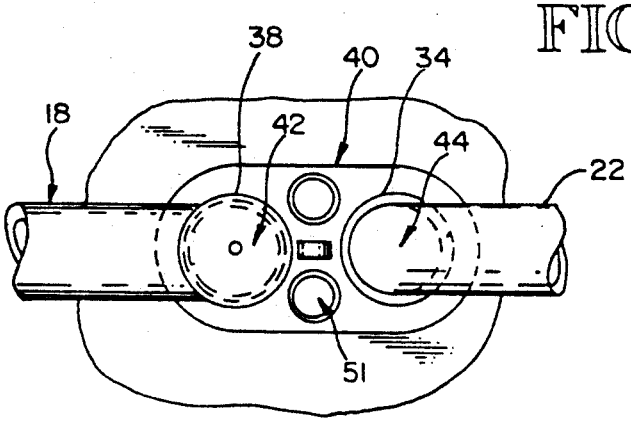
FIG. 2A
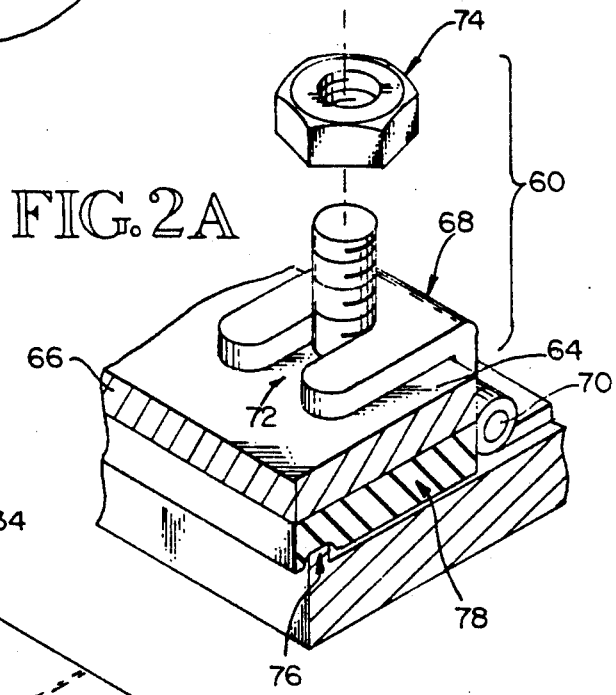
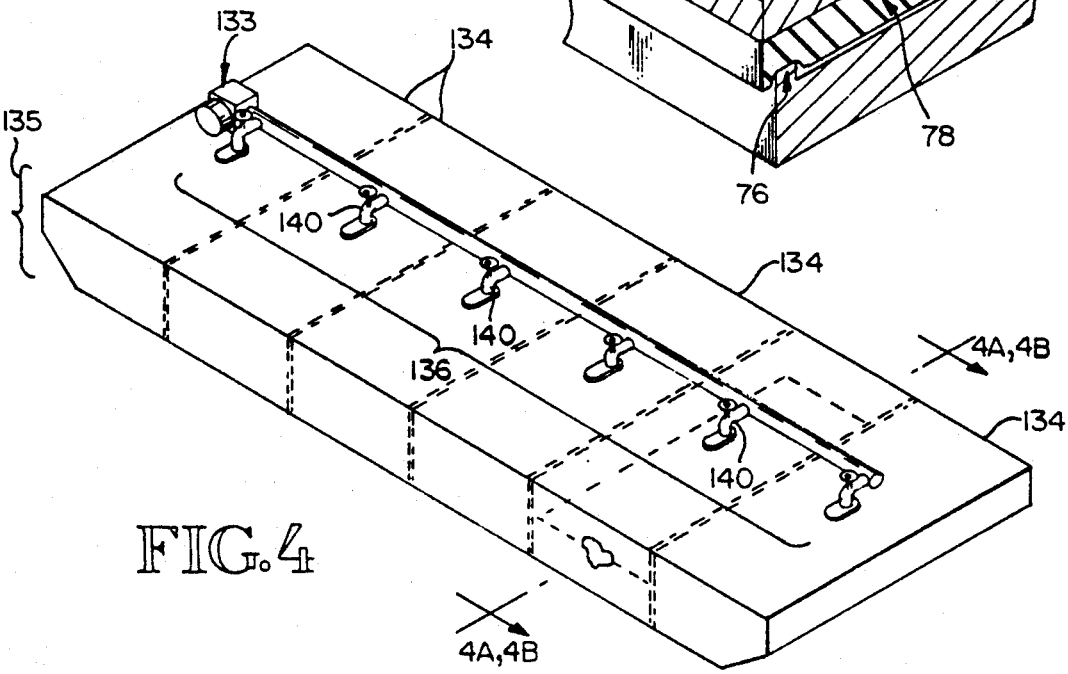
FIG. 4

180
182
184
186
188
190
202
9

210
212
214

190
191
192
196

190
194
198
200
180
192

APPARATUS AND METHOD FOR MINIMIZING AND RECOVERING FLUID CARGO SPILLS

TECHNICAL FIELD

The present invention relates to an apparatus for preventing or minimizing spilled fluid cargo such as crude oil, in a marine environment, and, more particularly, relates to a vacuum source connected by a multiple manifold to the holds of a marine cargo vessel, thereby evacuating the holds after they are filled, which minimizes or can even eliminate the loss of fluid cargo in the event of a breach.vacuum source. The vacuum source which is connected to a substantially airtight enclosure that, in turn, can be connected to a pickup mechanism that provides a passage from the enclosure to the material to be recovered. When the vacuum source is engaged, the enclosure is evacuated and the material is pulled through the pickup mechanism.

BACKGROUND OF THE INVENTION

The use of vacuum sources for recovering materials in a marine environment, particularly spilled fluid cargo on open water such as crude oil and associated debris, is well-known. Example of a typical device is disclosed in U.S. Pat. No. 3,813,887 to Kruger et al. Such devices typically use displacement pumps which pull the materials to be recovered through the pump itself.

Recent experience at the oil spill in Prince William Sound, Alaska shows that devices using displacement pumps are unsuited for such recovery work. The material that is to be recovered includes a great deal of debris, such as wood, dead animals, and pieces of cloth, as well as the spilled crude oil. Pulling this type of debris through a displacement pump causes frequent mechanical breakdowns with the attendant expense and time loss of repair. It is critical to recover the spill materials as soon as possible to minimize environmental damage as well as direct cost. Also, spilled petroleum products can develop into a material called mousse and clot as time passes, making recovery more difficult. Thus, these frequent breakdowns cause delays when time is critical.

Another problem is that devices for recovering fluid cargo spills usually not near the spill site and must be transported to it, causing delays in the initial recovery of the spill materials.

Of course, the most efficient way to limit damage from a fluid cargo spill is to minimize the amount of cargo spilled in the first place. Marine vessels transporting fluid cargos such as crude oil typically do not have systems to reduce the amount of cargo spilled that function very effectively. Examples of such systems are disclosed in U.S. Pat. No. 3,859,944 to Warner and U.S. Patent No. 4,241,683 to Conway. Warner discloses a system for transferring cargos from one hold to another, lining the holds with a puncture resistant liner, and automatically pressurizing a hold that has been breached to minimize the extent of a spill. Conway discloses the use of a three-dimensional grid of bulkheads and system for transferring cargo from one hold to another in the event of a breach to minimize lost cargo.

While these devices may minimize cargo spills somewhat, they may actually aggravate the problem under certain circumstances. For example, if a breach in a hold penetrated the liner in Warner, the automatic pressurization of the hold could actually force more fluid out of the hold. Also, systems like the one disclosed in Conway would require extensive additional construction on a vessel and would be difficult to retrofit.

As illustrated by the present discussion, there are a number of desirable features for an apparatus to minimize and recover fluid cargo spills in a marine environment. It would be desirable to have an apparatus that prevented or minimized the fluid cargo spill from a breach in a hold. In addition, it would be desirable for apparatus for spill recovery and spill minimization to be relatively inexpensive to install on new marine cargo vessels and to retrofit on older vessels. It would be desirable to have an apparatus for recovering materials in a marine environment using a vacuum source with a passage to a substantially airtight enclosure, such a marine cargo vessel hold that, in turn, has a pickup mechanism forming a passage between the enclosure and spill material to be recovered, so that the recovered materials pass directly into the enclosure without passing through the vacuum source. It also would be desirable to have an apparatus that could be installed on a marine vessel temporarily in the event of a fluid cargo spill or that could be installed on the vessel permanently. Further, it would be desirable to have an apparatus which could use a vacuum source to remove the sheen left on water after petroleum products have been released on the water.

While the above discussion was centered on apparatus for minimizing and recovering fluid cargo spills in a marine environment, it is not intended that the invention be limited to this situation. It will be obvious from the description that follows that the present invention will be useful in other applications with problems common to those described herein.

SUMMARY OF THE INVENTION

It is the object of the present invention to provide an apparatus to prevent or minimize the fluid cargo spilled in the event of a breach of a hold by using a vacuum source connected to the holds by a multiple manifold to evacuate the air from the holds.

It is another object of the present invention to provide an apparatus to minimize the amount of fluid cargo spilled in the event of a breach of a hold that can be installed in new marine cargo vessels and retrofitted in older vessels with relatively low cost.

It is the further object of the present invention to provide an apparatus to minimize the amount of fluid cargo spilled in the event of a breach of a hold that can also be used to recover materials in a marine environment.

It is yet another object of the present invention to provide an apparatus for recovering materials in a marine environment, using a vacuum source and constructed so that the recovered materials do not pass through the vacuum source.

It is also the object of the present invention to provide an apparatus for recovering materials in a marine environment which can be temporarily installed on a marine vessel in the event of a fluid cargo spill.

It is another object of the present invention to provide an apparatus for recovering materials in an marine environment which has a pickup mechanism that forms a passage between a substantially airtight evacuated enclosure, and the materials to be recovered from the marine environment.

It is yet a further object of the present invention to provide an apparatus for recovering materials from a marine environment which uses a pickup mechanism having multiple pickup points through which the materials can be recovered.

It is also the object of the present invention to provide an apparatus which could use a vacuum source to remove the sheen left on water when petroleum products have been released on the water by using a vacuum source acting through multiple pickups at or near the water surface.

The present invention achieves these objectives and other objectives which will become apparent from the description that follows, by providing a vacuum source connected to fluid cargo holds of a marine cargo vessel. The connections can be provided a plurality of passages, such as a multiple manifold. After the holds are filled with fluid cargo, the vacuum source is engaged, the air remaining in the holds is removed, and a vacuum is created within the holds. If a breach occurs in one of the holds, the spillage of the fluid cargo is minimized by the vacuum acting on the fluid cargo in the hold. In certain circumstances when the vacuum is sufficient and the fluid cargo has a lesser density than water, such as crude oil, water can actually enter through the breach into the hold and thereby prevent the spillage of fluid cargo from the breach.

Another preferred embodiment of the present invention uses a vacuum source, a substantially airtight enclosure connected to said vacuum source, and a pickup mechanism forming at least one pickup tube between the airtight enclosure and materials to be recovered. When the vacuum source is engaged, the enclosure is evacuated. In turn, a vacuum is created in the pickup mechanism and pickup tube. When the pickup mechanism is placed proximate the materials to be recovered, they are pulled through the pickup tube and into the enclosure. Thus, by not passing the materials through the vacuum source, the reliability and efficiency of the apparatus are increased significantly over earlier devices. It is envisioned that the apparatus will be used on marine vessel where it could be installed permanently on marine vessels using a compartment or hold as the enclosure, including the possibility of using the breached hold.

Alternatively, the apparatus could be used as a portable unit which can be transferred to the location of a fluid spill. This portable unit could be transported with a substantially airtight enclosure or could use a hold of the marine vessel involved in the spill.

In an alternative preferred embodiment of the present invention, a pickup mechanism is used that incorporates at least one pickup nozzle with a connector end and a suction end. The pickup nozzle connector end is attached to the pickup tube, and the suction end is placed proximate the materials to be recovered.

In yet another alternative preferred embodiment of the present invention, a pickup mechanism is use that incorporates at least two pickup tubes, with each pickup tube having a pickup nozzle with a connector end and a suction end. The pickup nozzles are connected to the pickup tubes as described in the alternative embodiment immediately above.

In a further alternative embodiment of the present invention, a pickup mechanism is used that incorporates at least one pickup nozzle with a connector end and a suction end. As with the above embodiments, the pickup nozzle connector end attaches to the pickup tube. In this embodiment, a suction end contains a rotating cylindrical drum which rotates the material to be picked up towards the open end of the pickup nozzle. The cylindrical surface can be configured in a number of ways to aid its pickup of the material to be recovered.

In a further preferred embodiment of the present invention, a pickup mechanism is used with at least two pickup tubes, each pickup tube having a pickup nozzle attached in the manner described in the above embodiments, in this configuration the pickup tubes are formed from a hollow device constructed of flexible, resilient material. Further, each of the pickup tubes is sufficiently long to enable the pickup nozzle to be maneuvered independently by propulsion means for each nozzle. This allows each of the pickup nozzles of the pickup mechanism to be maneuvered to facilitate the most efficient recovery of spilled material.

In another alternative preferred embodiment of the present invention, which may be incorporated with either the transportable unit or a unit permanently installed on a marine vessel, a port seal is provided. The port seal has a sealing assembly on a lower surface, and at least two apertures to provide connections with a vacuum source and at least one pickup mechanism assembly. The port seal has sufficient size to cover a port in a hold of a marine vessel.

One preferred embodiment of the sealing assembly used with a port seal uses a substantially resilient material, which covers at least a portion of the port seal lower surface. With this embodiment, when the port seal is placed over an open port and connected with a vacuum source, the hold is evacuated which, in turn, acts to pull the port seal against the port forming a substantially airtight seal.

Another preferred embodiment of the sealing assembly uses a plurality of clamps to attach the port seal to the port to form a substantially airtight seal. Yet another preferred embodiment of the sealing assembly uses substantially resilient material on the port seal's lower surface in combination with a plurality of clamps to form a substantially airtight seal.

Yet another preferred embodiment of the present invention uses a vacuum source connected to holds of a marine cargo vessel, and a port seal and pickup mechanism assembly. As in the above-discussed embodiment, the vacuum source is connected to the holds with a multiple manifold, and a vacuum is exerted on the holds to minimize the spillage of fluid cargo in the event of a breach. If spillage results from such a breach, the port seal is placed on a port of one of the holds and connected to the vacuum source, the vacuum source is engaged, and the spillage material is recovered through the pickup mechanism assembly with very little delay.

In yet another further preferred embodiment of the present invention, a vacuum source is connected to the holds of a marine cargo vessel using a plurality of passages such as a multiple manifold attached to each hold of the marine cargo vessel as a pickup tube and a pickup nozzle using the rotating, cylindrical drum embodiment described in an above embodiment. The pickup tubes and nozzles are arranged so that the longitudinal axis of the rotating cylindrical drums are substantially aligned on one side of the marine cargo vessel. After the vacuum source is engaged, the marine cargo vessel in this embodiment is propelled so that the side that has the plurality of pickup nozzles with rotating drums is moving through the material to be recovered. Thus, the marine cargo vessel has been turned into a sweeper barge which is capable of recovering substantial amounts of materials such as spilled crude oil in a relatively brief amount of time.

Yet another preferred embodiment of the present invention uses a vacuum source to remove the sheen left on water after petroleum products have been released on the water. In this alternative preferred embodiment, the vacuum source is connected to a plurality of pickups which float at or near the water surface. As the water with the petroleum sheen is pulled by the suction into the pickups, it passes into a substantially vertical collection tube where the petroleum sheen is separated from the water as they pass through separation plates. The petroleum sheen is retained while the substantially clean water passes out the bottom of the collection tube, thus minimizing the waste product requiring disposal.

Numerous other embodiments of the present invention may be achieved by combining different embodiments or aspects of embodiments described above. This summary of the invention is an attempt to disclose a representative sample of the important embodiments and their features, but is not meant in any way to be viewed as disclosing each embodiment possible with this invention.

BRIEF DESCRIPTION OF THE DRAWINGS

FIG. 1 is a partial isometric view of a preferred embodiment constructed in accordance with the present invention.

FIG. 2 is a partial side elevation view of a preferred embodiment constructed in accordance with the present invention.

FIG. 2A is a partial perspective view of an alternative preferred embodiment constructed in accordance with the present invention.

FIG. 3 is a partial top plan view of an alternative preferred embodiment constructed in accordance with the present invention.

FIG. 4 is an isometric view of an alternative preferred embodiment constructed in accordance with the present invention.

DETAILED DESCRIPTION OF PREFERRED EMBODIMENTS

Figure 1B:
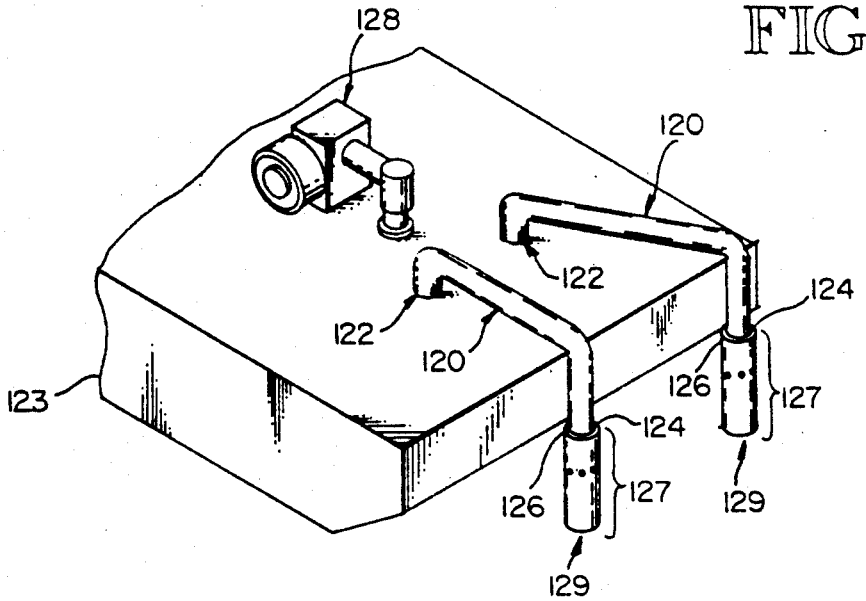
FIG. 1B is a partial isometric view of an alternative preferred embodiment constructed in accordance with the present invention.

With reference to FIG. 1, an apparatus 10 for recovering materials in a marine environment is disclosed. While one of the primary uses anticipated for this and other preferred embodiments of the present invention is the recovery of spilled fluid cargos, particularly crude oil and other petroleum products, the embodiments are equally useful in other applications involving the recovery and transfer of any materials in a marine environment, such as transferring fish from nets to holds on fishing vessels.

The recovery apparatus has a vacuum source 12, which can be a mechanical or electrical vacuum pump. Other vacuum sources are anticipated. The vacuum source is connected to a substantially airtight enclosure, in this case the hold 14 of a barge 16, by a vacuum passage 18 that is substantially airtight. Also connected to the substantially airtight enclosure is a pickup mechanism 20.

The pickup mechanism has at least one pickup tube 22, each pickup tube having a first end 24 and a second end 26. The pickup tube first end is connected to the hold. The pickup tube second tube is connected to a connector end 28 of a pickup nozzle 30, which also has a suction end 32 that is placed near the materials to be recovered and through which the materials enter the recovery apparatus. The connection 34 between the pickup tube and the hold, and the connection 36 between the pickup tub and the pickup nozzle are substantially airtight connections.

The pickup tube 22 can be constructed in a number of different ways and out of different materials that are well-known in the art. For this particular embodiment as illustrated in FIG. 1, the pickup tube is long enough to allow the pickup nozzle to reach the materials to be recovered. The pickup tube can be constructed from any material that is resilient and at least flexible enough to allow an operator to move the pickup nozzle near the materials to be recovered. The pickup tube cross-section can have any shape, e.g., circular, rectangular, ovular, etc., so long as its ends 24 and 26 can form substantially airtight connections with the hold or other enclosure and with the pickup nozzle.

Like the pickup tube, the pickup nozzle 30 can have a number of different embodiments. As shown in FIGS. 1 and 2, the pickup nozzle in this embodiment is an elongated metal cylinder with the connector end 28 and the suction end 32. While the pickup nozzle shown has a substantially circular cross-section, the cross-section shape can also be square, rectangular, ovular, etc., similar to the pickup tube shape.

In this embodiment, the pickup nozzle can be constructed from materials other than metal, such as plastic, if the material can provide sufficient structural integrity to allow the nozzle to suction material without collapsing or breaking apart. In this embodiment, a plurality of apertures 37 are arrayed about the pickup nozzle to prevent clumping of material in the nozzle and pickup tube, thereby assuring an uninterrupted flow of materials through the apparatus.

When the recovery apparatus is in operation, the vacuum source is engaged and the hold or other enclosure is evacuated. In turn, a vacuum is created in the pickup tube which creates a suction force at the suction end of the pickup nozzle. The materials to be recovered are pulled into the pickup nozzle, pass through the pickup tube, and are deposited into the hold without ever passing through the displacement pump or other vacuum source.

As a result, the recovery apparatus is much more reliable than systems which pass the recovered materials through the vacuum source, as well as being simply more efficient. A wider range in the size and shape of materials also can be recovered with the recovery apparatus disclosed herein. Experimentation has shown that the combination of improvements discussed above results in an apparatus which has a recovery rate significantly superior to the earlier devices.

The strength of the suction force at the pickup nozzle is affected by several factors. Basically, the upper limit of suction force is controlled by the rate at which the vacuum source can evacuate air from the hold or other enclosure, and the ability of the hold or other enclosure to remain substantially airtight and to retain its structural integrity under vacuum. Another factor discussed below is the number and size of pickup tubes and nozzles making up the pickup mechanism.

For the apparatus as illustrated in FIG. 1, the connection 38 between the vacuum passage and the hold and the connection between the pickup mechanism and the hold are formed using a port seal 40 with a first aperture 42 connecting the vacuum source to the enclosure, and a second aperture 44 connecting the pickup mechanism to the enclosure. As shown in greater detail in FIG. 2, the port seal is a plate that has an upper surface 46 and a lower surface 48, and with sufficiently large surface area to cover a port 50 in the hold 16. The port seal typically is made of metal, but other materials with sufficient rigidity also can be used. Vacuum relief valves 51 in the port seal are used to prevent the vacuum in the hold from becoming too great.

The port seal also has a seal assembly 52 which forms a substantially airtight seal between the port seal and the port lip 54 when the port seal is in place. The seal assembly can take several different embodiments. One embodiment as shown in FIG. 2 uses a substantially resilient material 56 attached to at least the portion of port seal lower surface which contacts the port lip when the port seal is in place. When the vacuum source is engaged, the vacuum within the evacuated enclosure exerts a downward force on the port seal which pulls the seal assembly against the port lip, creating a substantially airtight seal.

Another seal assembly embodiment uses a plurality of clamp devices 60, one of which is shown in FIG. 2A. The clamp device has a grooved stud 62 extending upwardly from the upper surface 64 of the port seal 66. A bracket 68, that is attached to the enclosure by a hinge 70, is positioned so that when it is rotated over the port seal, the stud slidably fits in a slot 72 in the bracket. After the bracket is rotated over the port seal, a lock nut 74 is placed on the stud and tightened. This procedure is repeated for all of the clamp devices which form a substantially airtight seal between the port seal and the port lip 76.

As shown in FIG. 2A, another embodiment of the seal assembly is possible by combining the two embodiments for the seal assembly discussed which uses the resilient material 78 in conjunction with the clamp devices. There are a number of other clamp devices which are well-known in the art that could be used in the seal assembly. Embodiments of the seal assembly other than the ones discussed are contemplated.

Figures 7, 8, 9, 10:
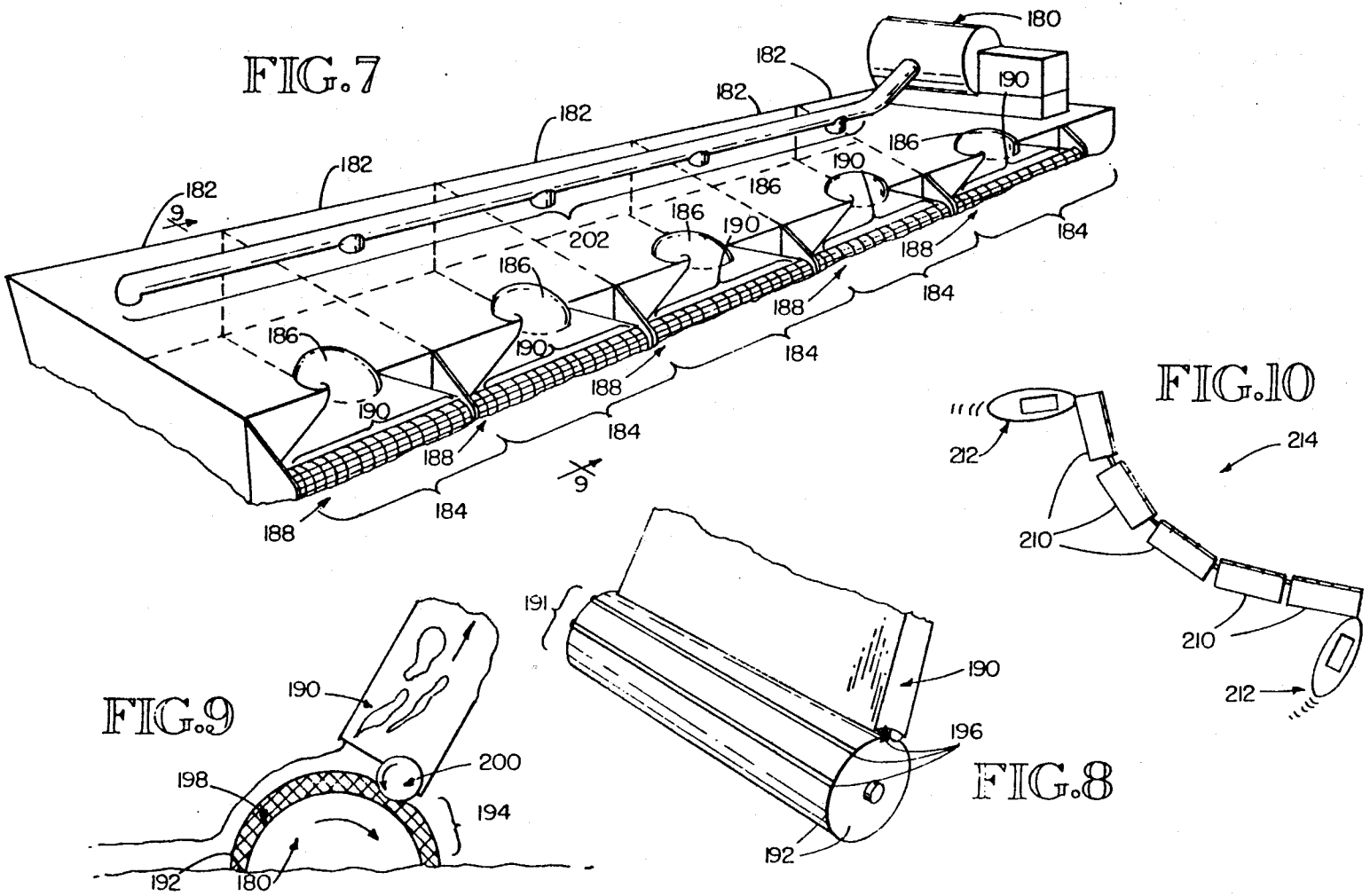
FIG. 7 is an isometric view of an alternative preferred embodiment constructed in accordance with the present invention.
FIG. 8 is a partial perspective view of an alternative preferred embodiment constructed in accordance with the present invention.
FIG. 9 is a cross-sectional view of an alternative preferred embodiment constructed in accordance with the present invention taken along lines 9 in FIG. 7.
FIG. 10 is a top plan view using several devices with the configuration of an alternative preferred embodiment constructed in accordance with the present invention.

As shown in FIGS. 1B and 7, it is possible to have preferred embodiments of the present invention that do not use a port seal. The port seal can either be permanently fixed in position or it can be placed over a port and connected to a vacuum source and pickup mechanism only when needed to recover materials such as after a fluid cargo has been breached.

Figure 6:
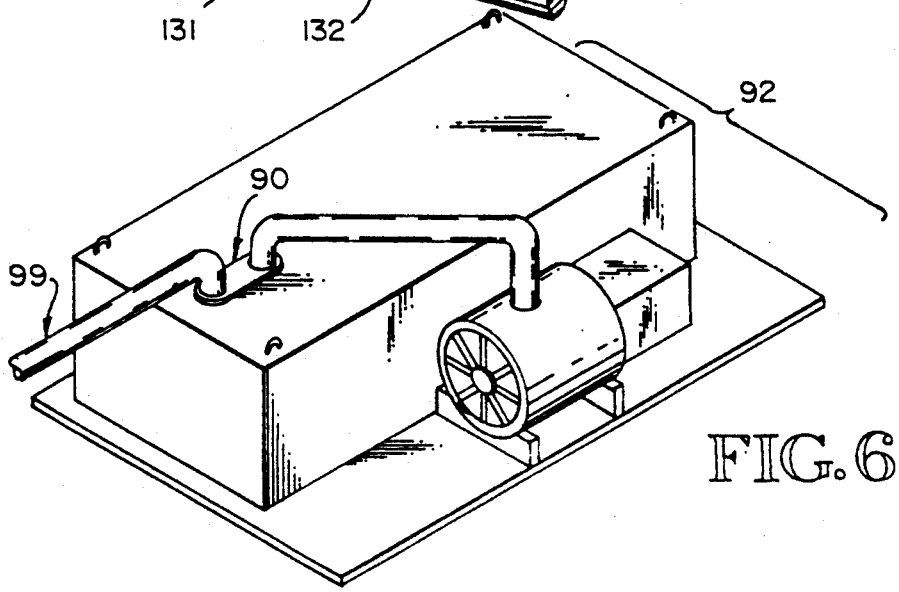
FIG. 6 is a partial isometric view of an alternative preferred embodiment constructed in accordance with the present invention.

In one preferred embodiment illustrated in FIG. 6, the portability of the port seal 90 is exploited by making it a component of a portable unit 92. The portable unit also includes a vacuum source 94 mounted to a bed 96 of metal, wood, or other rigid material which enables the unit to be transported by air, sea, or land. A portable substantially airtight enclosure 98 may be included with the portable unit, or a hold on a marine vessel can be used with the port seal.

Figure 1A:
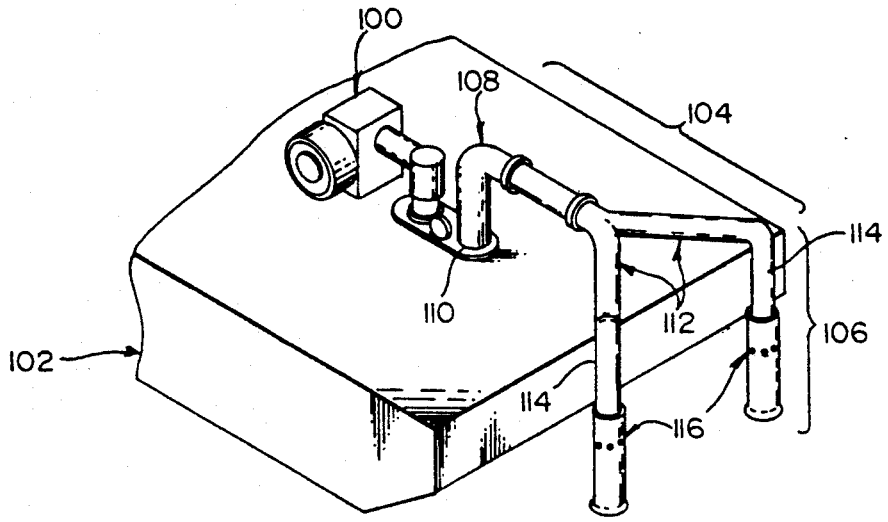
FIG. 1A is a partial isometric view of an alternative preferred embodiment constructed in accordance with the present invention.

Another preferred embodiment of the present invention is shown in FIGS. 1A and 1B. As with the embodiment discussed above, this embodiment involves a vacuum source 100, a substantially airtight enclosure, such as a hold 102 of a marine cargo vessel, and a pickup mechanism 104. In this embodiment, however, the pickup mechanism has at least two pickup nozzles 106 with which to recover materials from a marine environment. There are a number of connecting multiple pickup nozzles to the enclosure, and thereby, the vacuum source. In FIG. 1A, a single pickup tube 108 having a first end 110 connected to the enclosure is used. Along its length, the pickup tube splits into at least two secondary tubes 112 with each secondary tube having a second end 114 that is connected to a connector end 116 of a pickup nozzle.

Figure 3A:
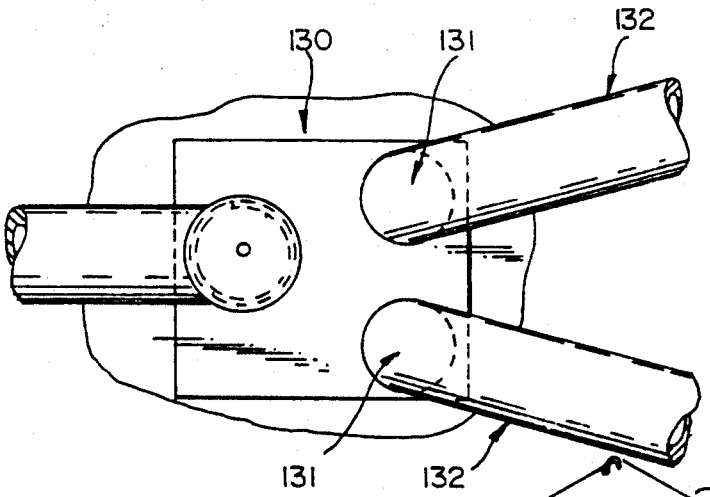
FIG. 3A is a partial top plan view of an alternative preferred embodiment constructed in accordance with the present invention.

The pickup mechanism in FIG. 1B uses two pickup tubes 120 with each pickup tube having a first end 122 connected to the enclosure and a second end 124 connected to the connector end 116 of a pickup nozzle. Any number of pickup nozzles can be used in this embodiment. The strength of the vacuum source and the desired force at the pickup nozzles' suction end 126 are the only limitation on the number of pickup nozzles used in this embodiment. Although the embodiment shown in FIG. 1B does not use a port seal, a port seal readily could be modified to have multiple apertures to make connections with more than one pickup hose, as shown in FIG. 3A.

Figure 4A:
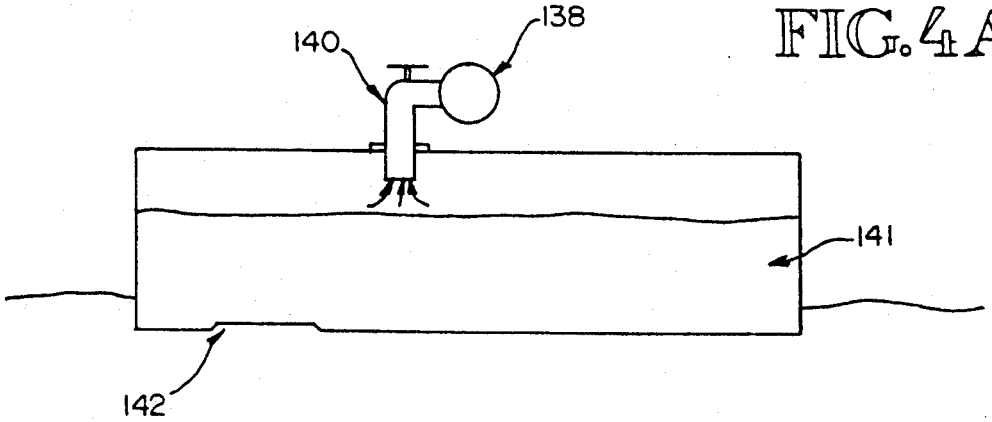
FIG. 4A is a cross-sectional view of an alternative preferred embodiment constructed in accordance with the present invention taken along lines 4A in FIG. 4.
Figure 4B:
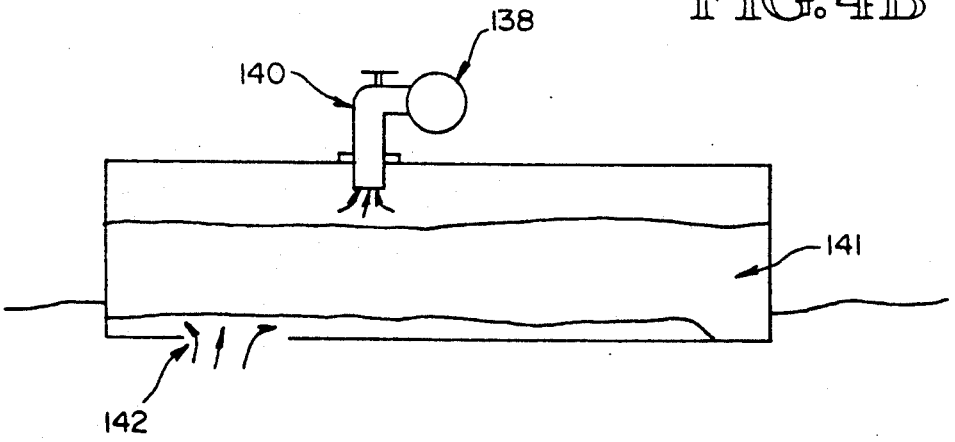
FIG. 4B is a cross-sectional view of an alternative preferred embodiment constructed in accordance with the present invention taken along lines 4B in FIG. 4.

As illustrated in FIG. 4, a preferred embodiment of the present invention can prevent or minimize spillage of fluid cargo from a breached fluid cargo hold. This embodiment uses a vacuum source 130 that is connected to fluid cargo holds 132 of a marine cargo vessel 134 in a substantially airtight manner. A multiple manifold 136 is used. The multiple manifold has a main tube 138 connected at one end and open to the vacuum source and a plurality of secondary tubes 140 where each secondary tube connects and is open to the main tube and one of the holds. Other devices can be used to connect the vacuum source and the individual holds such as individual tubes from the vacuum source to each hold.

After the fluid cargo holds have been filled, the vacuum source is engaged and the remaining air in the holds is evacuated, creating a negative pressure in each of the holds. In the event that one or more of the fluid cargo holds are breached, the negative pressure in the holds exerts a retarding force that prevents or at least minimizes the flow of fluid cargo from any breach, as shown in FIG. 3A.

In the situation where the breach is at or near the bottom of the vessel and the density of the fluid cargo is less than that of water, such as crude oil, the retarding force from the negative pressure may actually pull water through the breach and into the hold. This creates a barrier layer of water on which the fluid cargo can float between the cargo and the breach, as shown in FIG. 3B. In this situation, this embodiment may prevent any spillage of fluid cargo.

Figure 5:
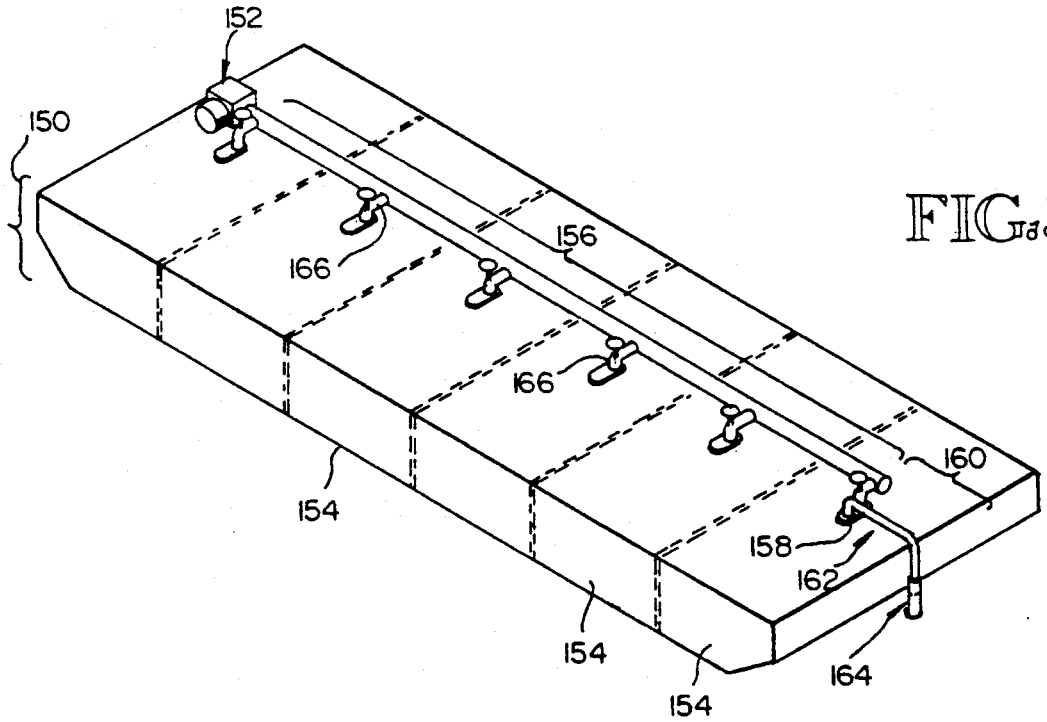
FIG. 5 is an isometric view of an alternative preferred embodiment constructed in accordance with the present invention.

The above embodiment for preventing or minimizing the loss of fluid cargo in the event of a breach in the hold can be used with any of the embodiments discussed herein to recover spilled fluid cargo. A specific example is illustrated in FIG. 5 where the barge 150 has a vacuum source 152 connected to individual cargo holds 154 by a multiple manifold 156. By utilizing port seal 158, a pickup mechanisms 160 can also be connected to one of the cargo holds. For illustrative purposes in this embodiment, the pickup mechanism consists of a pickup tube 162 and a pickup nozzle 164, but any of the pickup mechanisms described herein for recovering spilled fluid cargo can be combined with the apparatus for minimizing the spillage of fluid cargo.

In operation, the embodiment illustrated in FIG. 5 is virtually identical to the embodiments which features it combines. Prior to a breach, the holds are filled with fluid cargo and then the remaining air is evacuated from each of the cargo holds creating a negative pressure within each hold. When the breach occurs, as discussed above, the negative pressure in the hold creates a retarding force that minimizes the flow of fluid cargo from the breach. At the same time the valves 166 to each of the holds can be closed except for the valve for the hold which has the pickup mechanism attached. With the remaining valve open and closing the other valves, the vacuum available to provide suction force through the pickup mechanism is maximized. The pickup nozzle can then be maneuvered to suction up any spilled fluid cargo through the pickup tube into the hold being used as the substantially airtight container.

Thus, a marine cargo vessel utilizing this embodiment has first prevented or minimized the fluid cargo spilled in the event of breach, and then without any external intervention, has quickly begun recovering any fluid cargo that was spilled. There is virtually no time lost waiting for skimmers or other recovery devices to be delivered to the stricken vessel. The result is any damage to the marine environment is greatly decreased in the event of a breach of the marine vessel.

Yet another embodiment is an apparatus for recovering materials in a marine environment is illustrated in FIGS. 7-9. In this embodiment, as in the above embodiments, the vacuum source 180 is used with one or more substantially airtight enclosures 182 and one or more pickup mechanisms 184. In this embodiment the pickup mechanism includes a pickup tube 186 which connects the substantially airtight enclosure to a pickup nozzle with a rotating cylindrical drum 188. As shown in FIG. 7, the pickup tube connects to the connector end of the pickup nozzle, which also has a suction end that has a wide mouth 190. In the wide mouth there is the transversely mounted rotating cylinder drum. The outer surface 182 of the cylindrical drum is covered with some sort of recovering means 194 which enables it to attract or hold materials on the water surface, such as spilled or crude oil and deliver it to the pickup nozzle wide mouth.

Two possible embodiments of the recovery means are illustrated in FIGS. 8 and 9. In FIG. 8, the outer surface of the rotating cylindrical drum has a plurality of ridges 196 extending substantially along its length. As the drum rotates materials floating at or near the water surface are picked up by the ridges and rotated up to the pickup nozzle wide mouth where the suction force pulls the materials through the pickup tube into the substantially airtight enclosure. In FIG. 9, the outer surface of the rotating cylindrical drum is covered with an oil-absorbent material 198. In this embodiment, as the cylindrical drum rotates through the spilled materials, materials are absorbed into the oil-absorbent material. As the drum rotates, the oil-absorbent material passes under a squeezing roller 200 which extends substantially along the length of the rotating cylindrical drum and acts as a squeegee, forcing the absorbed material out of the recovering means into the vacuum of the pickup tube.

Rotating the cylindrical drum can be achieved by a number of ways well known in the art that include a belt-driven mechanism, or a hydraulic or electric motor attached directly to the rotating drum.

FIG. 7 illustrates an application of the pickup mechanism utilizing the rotating cylindrical drum. In this embodiment, the substantially airtight enclosures are the holds of a marine cargo vessel and attached to the vacuum source by multiple manifold 202. One pickup mechanism using the rotating cylindrical drum is provided for each airtight enclosure. Further, all of the pickup mechanisms are located on one side of the barge with the longitudinal axis of each of the rotating cylindrical drums substantially aligned.

As a result, when the marine vessel is moved in a direction substantially normal to the longitudinal axes of the rotating cylindrical drums to an area containing materials such as spilled crude oil, the rotating cylindrical drums will pick up or absorb spilled materials rotated upward, out of the water, toward the pickup nozzle wide mouth where it will be sucked through the pickup tube into the substantially airtight enclosure. Thus, in this embodiment the marine cargo vessel has been transformed into a "sweeper barge." FIG. 10 illustrates the use of a plurality of sweeper barges 210 connected together and being propelled by two tug boats 212 through an area of spilled fluid.

Figure 11:
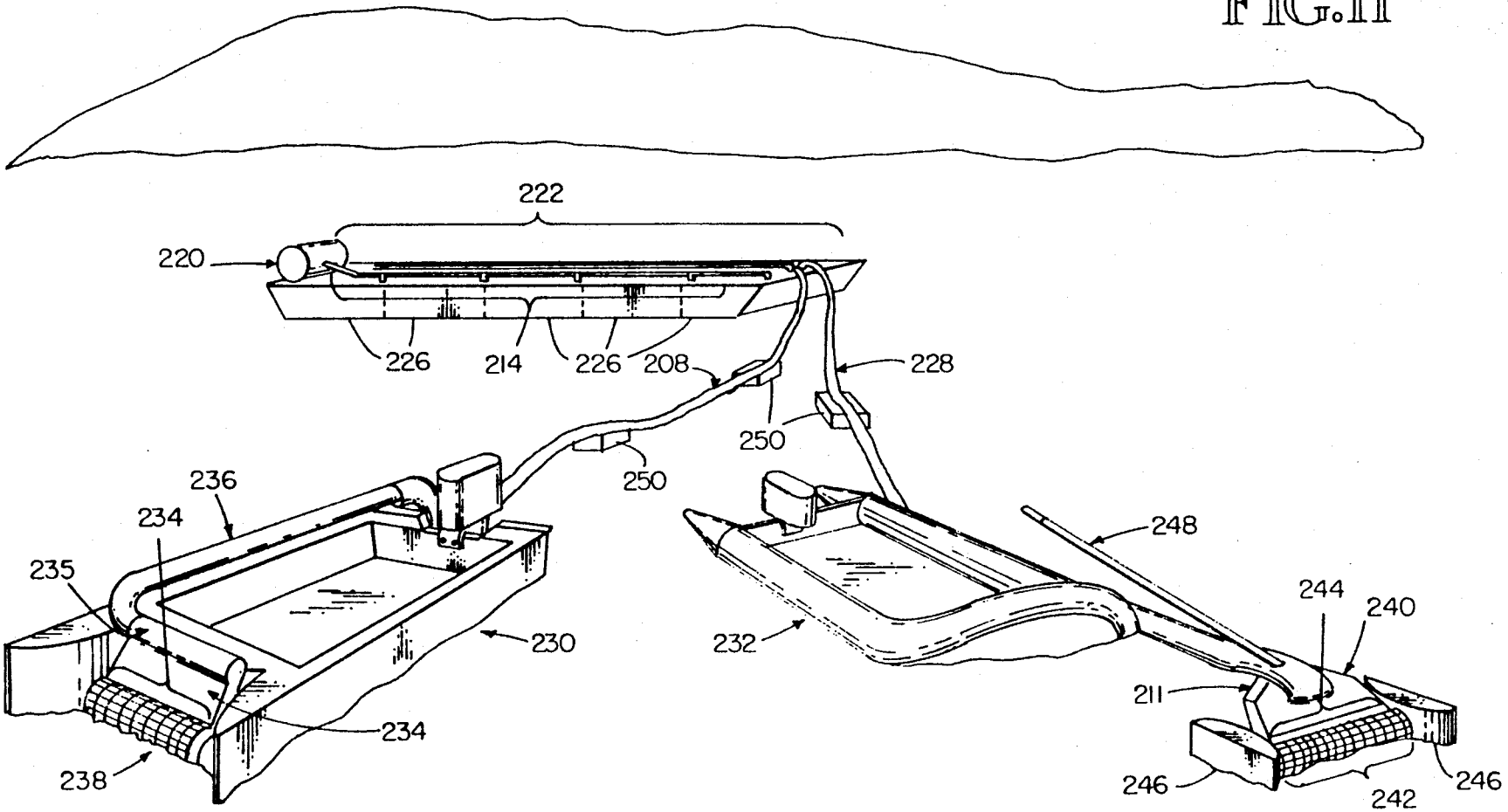
FIG. 11 is an environmental isometric view of an alternative preferred embodiment constructed in accordance with the present invention.

FIG. 11 illustrates another preferred embodiment which utilizes the rotating cylindrical drum concept for recovering materials in a marine environment. In this embodiment, the vacuum source 220 is located on a marine cargo vessel 222 and is connected by a multiple manifold 224 to holds 226 which serve as substantially airtight enclosures. Extending from one of the marine cargo vessel's holds are two substantially flexible pickup tubes 228 which are in turn connected to independently powered vessels 230 and 232. Vessel 230 has a pickup nozzle wide mouth 234 attached to the front of it. The back of the pickup nozzle is attached by an interconnecting hose 236 to the pickup tube, and thus, the evacuated hold. A rotating cylindrical drum 238 is transversely attached to the pickup nozzle wide mouth and operates in virtually the identical manner as the embodiments employing the rotating cylindrical drums described above. This embodiment, however, can be maneuvered independently of the marine cargo vessel.

The second independent vessel 232 also uses a pickup nozzle with wide mouth 240 and is connected to the pickup tube at its connector end 241. The pickup nozzle wide mouth has a rotating cylindrical drum 242 transversely attached to it. This pickup mechanism is supported by floats 246 and has a handle 248 attached so that it can be maneuvered by someone located in the independent vessel. In this particular embodiment, the independent vessel 232 can be maneuvered, and further, the pickup nozzle and rotating cylindrical drum can be maneuvered independently of the independent vessel. Due to their length, the pickup hoses are supported by floats 250. The recovery means on the surface of the rotating drums for each of these embodiments is the same as those discussed above.

Figures 12, 13:
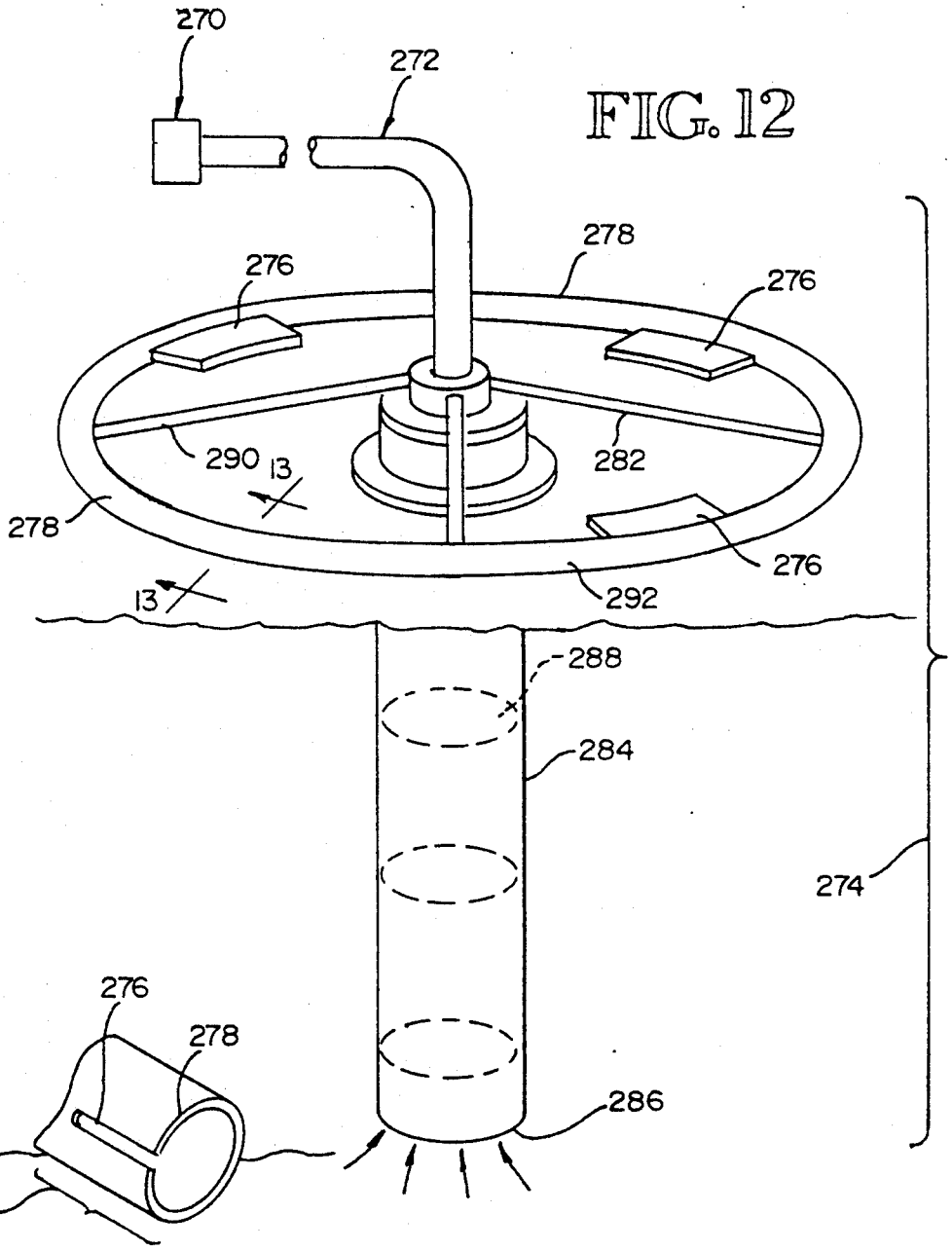
FIG. 12 is an isometric view of an alternative preferred embodiment constructed in accordance with the present invention.
FIG. 13 is a cross-sectional view of an alternative preferred embodiment constructed in accordance with the present invention taken along lines 13 in FIG. 12.

An alternative preferred embodiment of the present invention is illustrated in FIGS. 12 and 13 and is used to remove the sheen left on water after petroleum products have been released on the water. This embodiment uses a vacuum source 270 connected by a tube 272 to the petroleum sheen recovery device 274. The petroleum recovery device has a plurality of pickups 276 which in this embodiment are made from a plastic tube 278 with a plurality of slots 279 in a circular configuration although numerous configurations for the pickups are possible.

The pickups are connected to a central vacuum head 280 by vacuum support tubes 282. The central vacuum head is also connected to the tube from the vacuum source. The vacuum head rests atop a collection tube 284, which has an open bottom 286 and contains at least one separation plate 288. The separation plates can be constructed from any resilient material that allows the plate to constructed in a manner to pass water while retaining materials such as petroleum products. Examples are perforated metal or plastic plates, or heavy gauge woven plastic. The recovery device is supported by floats 290.

In operation, the vacuum source is engaged, creating a suction in vacuum support tubes and the pickups. As best shown in FIG. 13, the pickups are kept at or near the water surface. To allow for variations in elevation, the ring containing the pickups is connected to the vacuum support tubes with flexible couplings 292. The water containing the petroleum sheen is sucked through the pickups, into the vacuum support tubes, and deposited into the collection tube.

As the water containing the petroleum sheen passes through the collection tube, the petroleum sheen is separated from the water by the separation plates, thus cleaning the water. The petroleum sheen is retained in the upper portion of the collection tube while the clean water passes out the open bottom of the collection tube. This minimizes the amount of waste material requiring disposal and gives a effective infinite collection apparatus.

The collection tube can be constructed from any sufficiently rigid material including metal or plastic. The diameter of the collection tube can vary from a few inches to several feet depending on the strength of the vacuum used and amount of material to be recovered.

The flow of water through the collection can be enhanced by the use of a pump. Also, a vacuum source may be attached directly to the petroleum sheen recovery device. This embodiment is useful in any situation where petroleum products are released in limited amounts on water. Besides areas near oil spills, any dock or harbor situation where small amounts of materials such as oil or gas are released can use this embodiment. This embodiment could be a portable unit as well as a permanently installed device attached to a dock.

The embodiments discussed herein are an attempt to a provide representative sample of the preferred embodiments of the present invention. It is apparent that taking the different features of the embodiments discussed herein, any number of preferred embodiments are possible. For example, the rotating cylindrical drum combined with a pickup mechanism could be used with the portable unit described above and illustrated in FIG. 6. Also, the port seal mechanism described in a number of the above embodiments could be used with the rotating cylindrical drum embodiments. Those skilled in the art will readily appreciate such combinations and variations are possible upon careful review of the above disclosure. Therefore, the present invention is not limited by the above description, but is to be determined by the scope of the claims which follow.

What is claimed is:

1. An apparatus for recovering a sheen from a water surface, the sheen being formed from a petroleum material, said apparatus comprising:

a vacuum source;

a vacuum head connected to said vacuum source in a substantially airtight manner;

a plurality of pickups connected to said vacuum head by at least one substantially airtight tube, said pickups located at or near water surface; and a substantially vertical collection tube with an internal passage, an open top, an open bottom, said vacuum head being attached to said open top in a substantially airtight manner, said collection tube containing at least one separation plate means for allowing water to pass while retaining said petroleum material, where each said preparation plate means is mounted across said collection tube internal passage.

2. An apparatus for recovering materials in a marine environment, comprising:

a displacement pump;

a substantially airtight hold of a vessel connected to said displacement pump by a substantially airtight vacuum passage, said hold incorporating a vacuum relief device;

a port in said hold;

a port seal, said port seal having an upper surface and alower surface, and being of sufficient size to completely cover said port, and further having a sealing assembly, said sealing assembly forming a substantially airtight seal when said port seal is placed over said port, said sealing assembly further comprising a substantially resilient material at least partially covering said port seal lower surface, said resilient material forming a substantially airtight seal when said port seal lower surface is placed over said port, said port seal having at least two apertures, with at least one said aperture connected to said displacement pump;

a pickup mechanism, said pickup mechanism being connected to said aperture and forming at least one substantially airtight passage between said enclosure and said materials in said marine environment, said pickup mechanism further comprising at least one pickup nozzle, each said pickup nozzle being substantially cylindrical and having a connector end and a suction end, wherein each said pickup nozzle further comprises a plurality of apertures arrayed around said pickup nozzle a distance from said suction end, where the distance for each said aperture is approximately equal; and at least one pickup tube having at least two ends, with at least one said end of each said pickup tube being connected to one said port seal aperture and each remaining said end of each said pickup tube being connected to said connector end of one said pickup nozzle with all said connections being substantially airtight so that when said displacement pump is engaged and said enclosure is evacuated, material are sucked into said suction end and through said pickup nozzle and pickup tube into said enclosure.

3. An apparatus for recovering materials in a marine environment, comprising:

a vacuum source;

a substantially airtight hold of a marine vessel connected to said vacuum source by a substantially airtight vacuum passage; and a pickup mechanism, said pickup mechanism forming at least one substantially airtight passage between said enclosure and said materials in said marine environment, said pickup mechanism further comprising:

at least one pickup nozzle, each said pickup nozzle being substantially cylindrical and having a connector end and a suction end; and at least one pickup conduit having at least two ends, with at least one said end of each said pickup conduit connected to said connector end of said at least one pickup nozzle and at least one remaining said end of each said pickup conduit connected to said airtight enclosure so that when said vacuum source is engaged and said enclosure is evacuated, materials are sucked into said suction end and through said pickup nozzle and pickup conduit into said enclosure, wherein each said pickup nozzle further comprises a plurality of apertures arrayed around said pickup nozzle a distance from said suction end, where the distance for each said aperture is approximately equal.

4. An apparatus for recovering materials in a marine environment as claimed in claim 3, wherein said apparatus further comprises:

a port in said hold;

a port seal, said port seal having an upper surface and a lower surface, sufficient in size to completely cover said port, said port seal further having a sealing assembly forming a substantially airtight seal when said port seal is placed over said port; and at least two apertures in said port seal, with at least one said aperture connected to said vacuum source, and at least one other said aperture connected to said pickup mechanism.

5. An apparatus for recovering materials in a marine environment as claimed in claim 4, wherein said pickup mechanism further comprises each remaining said end of each said pickup conduit connected to said connector end of one said pickup nozzle with all said connections being substantially airtight.

6. An apparatus for recovering materials in a marine environment as claimed in claim 4, said sealing assembly further comprising a substantially resilient material at least partially covering said port seal lower surface, said resilient material forming a substantially airtight seal when said port seal lower surface is placed over said port.

7. An apparatus for recovering materials in a marine environment as claimed in claim 3, wherein said hold incorporates a vacuum relief device.

8. An apparatus for recovering materials in a marine environment as claimed in claim 3, wherein said vacuum source is a displacement pump.

9. A method for recovering petroleum materials from a water surface, said method comprising the steps of:

providing a vacuum source;

connecting a vacuum head to said vacuum source in a substantially airtight manner;

connecting at least one pickup to said vacuum head by at least one substantially airtight conduit;

locating said pickup at or near said water surface;

pulling a mixture of the petroleum materials and water from the water surface through said pickup;

providing a substantially vertical collection tube with an internal passage, the collection tube having an open top, an open bottom, and containing at least one separation plate means for allowing water to pass while retaining said petroleum material, where each said separation plate means is mounted across said collection tube internal passage; and placing said vacuum head on said collection tube, thereby allowing water to pass and retaining said petroleum materials on said separation plate means;

* * * * *

UNITED STATES PATENT AND TRADEMARK OFFICE

CERTIFICATE OF CORRECTION

PATENT NO. : 5,143,629

DATED : September 1, 1992

INVENTOR(S) : Christian L. Lint

It is certified that error appears in the above-identified patent and that said Letters Patent is hereby corrected as shown below:

In column 12, claim 1, line 47, please delete "preparation" and substitute therefor -- separation --.

In column 12, claim 2, line 59, please delete "alower" and substitute therefor -- a lower --.

In column 13, claim 2, line 22, please delete "material" and substitute therefor -- materials --.

In column 14, claim 9, line 48, please delete "material" and substitute therefor -- materials --.

Signed and Sealed this

Twenty-first Day of September, 1993

Bruce Lehman

*Attest:*

BRUCE LEHMAN

*Attesting Officer*

*Commissioner of Patents and Trademarks*